US005487691A

United States Patent [19]

Chiu

[11] Patent Number: 5,487,691

[45] Date of Patent: Jan. 30, 1996

[54] SPHERE AND ROD CONSTRUCTION TOY

[75] Inventor: Frank T. S. Chiu, Tuen Mun, Hong Kong

[73] Assignee: Yip Tai Toys Industrial Ltd., Tuen Mun, Hong Kong

[21] Appl. No.: 213,699

[22] Filed: Mar. 16, 1994

[30] Foreign Application Priority Data

Jan. 3, 1994 [CN] China ..... 94200035.8

[51] Int. Cl.[6] ..... A63H 33/12

[52] U.S. Cl. ..... 446/126; 446/102

[58] Field of Search ..... 446/85, 102, 119, 446/122, 123, 126; 434/277, 278, 281

[56] References Cited

U.S. PATENT DOCUMENTS

| | | | |
|---|---|---|---|
| Re. 33,785 | 12/1991 | Hildebrandt et al. | 446/126 |
| 1,113,371 | 10/1914 | Pajeau | 446/126 |
| 2,962,820 | 12/1960 | Petersen | 446/102 |
| 2,970,388 | 2/1961 | Yonkers | 446/102 |
| 3,286,391 | 11/1966 | Mengeringhausen | 446/102 |
| 3,998,003 | 12/1976 | Rosenbaum | 446/119 |
| 4,129,975 | 12/1978 | Gabriel | 446/126 |
| 4,781,644 | 11/1988 | Yoshida | 446/123 |

FOREIGN PATENT DOCUMENTS

| | | | |
|---|---|---|---|
| 956423 | 1/1950 | France | 446/126 |
| 1425234 | 2/1965 | France | 434/278 |
| 539143 | 11/1931 | Germany | 446/126 |
| 6225 | of 1914 | United Kingdom | 446/126 |

*Primary Examiner*—Robert A. Hafer
*Assistant Examiner*—Jeffrey D. Carlson

[57] ABSTRACT

A construction toy comprises generally spherical construction members having threaded openings provided thereon and rod members having extensible and contractible screw members provided at each end thereof. Five threaded openings are disposed at both the upper and lower hemispheres of the spherical members. One of the five threaded openings is disposed along a central vertical axis whereas the other four at an angle of 45 degree from the axis. Four to eight threaded openings are disposed along the equator of the spherical members. Each end of the rod member has an extensible and contractible screw and a screw fastening device. A variety of patterns, models, and objects can be constructed by using the spherical and rod construction members.

5 Claims, 2 Drawing Sheets

SPHERE AND ROD CONSTRUCTION TOY

BACKGROUND OF THE INVENTION

The present invention relates to an educational toy and in particular to a construction toy for the construction of various shaped figures by inserting and joining construction pieces.

Educational toys are known in prior art. Most of the educational construction toys involve the insertion and connection of construction pieces by following certain predetermined construction patterns. In this way, the imagination of children cannot be fully explored. Since there are only a few construction patterns, players may find the toy to be boring soon. Players have to purchase more new construction pieces in order to keep the construction toy fun to play with. This would become a financial burden to the players. This would also create difficulties for manufacturers in manufacturing, designing, and pricing of the toys.

SUMMARY OF THE INVENTION

An object of the present invention is to provide an educational construction toy which allows the players to easily and freely construct a variety of patterns, models, and objects by using only two kinds of construction pieces.

The educational construction toy of the present invention comprises spherical construction members and construction rod members for connecting the spherical construction members. Each spherical construction member is in the form of a hollow sphere. Five internally threaded openings are provided at both the upper and lower hemispheres of the spherical construction member. Four to eight internally threaded openings are provided along the equator of the spherical construction member. The axes of all threaded openings pass through the center of the spherical construction member.

Each construction rod member is in the form of a connecting rod having extensible and contractible screw means.

One of the five threaded openings at the upper and lower hemispheres of the spherical construction member is disposed along the vertical axis of rotation of the spherical construction member. The other four threaded openings are disposed at an angle of 45 degree from the central vertical axis.

Each construction rod member comprises a hollow rod member, each end of which having a screw, an orientation pin, a ring member, and a screw fastening sleeve member with orientation slots. The ring member is adhered to the inner wall of the hollow rod member at the end thereof. The screw is moveably received in the ring member. The threaded portion of the screw extends out the end of the rod member whereas the screw head portion is received within the hollow rod member. An orientation pin is fixedly received in a transverse opening provided at the central shaft portion of the screw. The screw fastening sleeve member is slidably connected along the screw between the ring member and the orientation pin. The front end portion of the sleeve member is hexagonal or square in shape.

Another embodiment of the spherical construction member is a 14–18 surfaced member having flat surfaces at the 14–18 threaded openings of the above-mentioned spherical member.

A variety of patterns, models, and objects, as originally illustrated or as freely imagined by the players, can be constructed by using the above-mentioned spherical construction members, or the 14–18 surfaced members, and the construction rod members. In order to easily, reliably and accurately build constructions, it is required that the 14–18 threaded openings be arranged on the spherical construction member as mentioned above. The axes of the threaded openings are disposed at 45, 60, and 90 degree from the vertical central axis of the spherical construction member. These angles should be very accurate. The construction rod members with extensible and contractible screw means make the insertion and connection of the construction toy pieces as easy, firm, and practical as possible.

Various patterns, models, and objects may therefore be constructed by using only the two kinds of construction members of the present invention. The construction toy of the present invention is easy to assemble, firm in structure and accurate in construction. The construction toy can be used to explore the imagination of children. The construction toy can also be used as an educational toy in school or as an artistic decoration at home.

BRIEF DESCRIPTION OF DRAWINGS

Specific embodiments of the invention will now be described by way of example with reference to the accompanying drawings wherein.

DESCRIPTION OF THE PREFERRED EMBODIMENT

Figure 1:
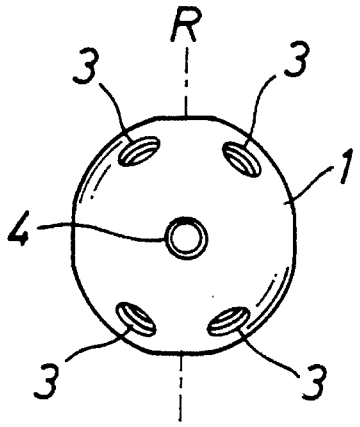
FIG. 1 is a front view of a spherical construction member of the present invention.
Figure 2:
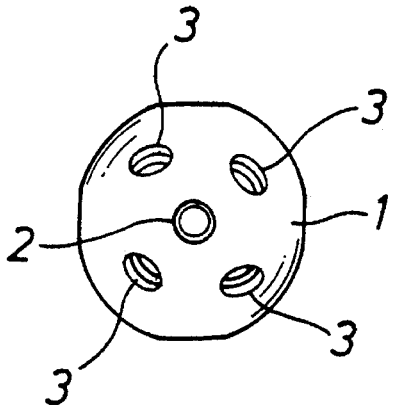
FIG. 2 is a plan view thereof.

FIGS. 1 and 2 respectively show the front and plan views of a hollow spherical construction member 1 embodying an embodiment of the present invention. Five internally threaded openings are provided at the upper and lower hemispheres of the hollow spherical construction member 1. One of the five internally threaded openings 2 is disposed on the spherical construction member 1 at a central vertical axis R. The other four internally threaded openings 3 are disposed on the spherical construction member 1 at an angle of 45 degree from the axis R. The angles between the axes of the threaded openings 3 are 60 degree. Four to eight internally threaded openings 4 are disposed along the equator of the spherical construction member 1. The angle between the axis of the threaded opening 4 and the axis of the threaded opening 2 is 90 degree.

According to the present embodiment, four internally threaded openings 4 are disposed along the equator of the hollow spherical construction member 1. The distance between each threaded opening 4 and each adjacent threaded opening 3 is the same. The angle between the axis of the threaded opening 4 and the axis of the adjacent threaded opening is 60 degree.

According to the present embodiment, the surfaces of the hollow spherical construction member 1 at the threaded openings are flat.

Figure 3:
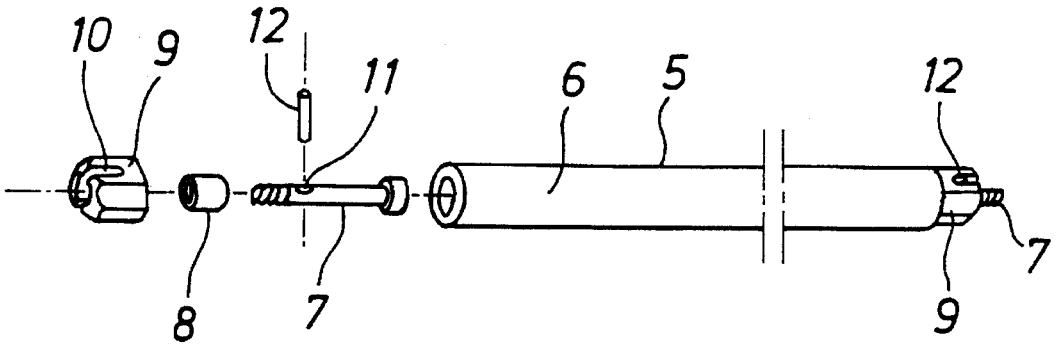
FIG. 3 is a fragmentary exploded view of a construction rod member of the present invention.

Referring now to FIG. 3, the main component of the construction rod member 5 is a hollow rod member 6. The ends of the rod member 5 have extensible and contractible connecting end portions. Each end portion comprises a screw 7, a ring member 8, a screw fastening sleeve member 9 having orientation slots 10, and an orientation pin 12 fixedly received in a transverse opening 11 of the screw 7. The head portion of the screw 7 may be round or hexagonal in shape. The outer diameter of the ring member 8 conforms with the inner diameter of the hollow rod member 6. The ring member 8 is adhered to the inner wall of the hollow rod member 6 at the end thereof. The screw fastening sleeve member 9 is hexagonal or square in shape and acts as a nut by which the construction rod member 5 can be screwed into the spherical construction member 1 by means of a conventional wrench.

Figure 4:
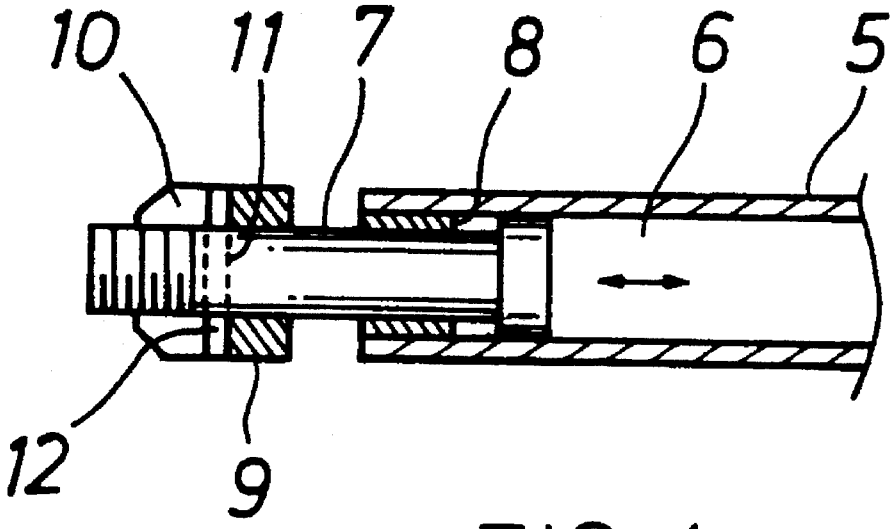
FIG. 4 is a longitudinal fragmentary sectional view of an end portion of a construction rod member.

Referring to FIG. 4, the ring member 8 carrying the screw 7 is secured to the inner wall at the end of the hollow rod member 6 with the threaded portion of the screw 7 extending outwards. The screw fastening sleeve portion 9 is moveable along the screw 7. The screw 7 itself is moveably received within the ring member 8, as shown by the arrow. This renders the connecting rod member 5 to become extensible and contractible. In order to connect an end of the rod member 5 to the spherical construction member 1, the screw 7 is screwed into a threaded opening of the spherical construction member 1 by wrenching the screw fastening sleeve member 9 of the rod member 5 with a wrench; the pin in slot 10 allows the sleeve to tighten the screw into the threaded opening. The connection is tightened when the front end of the sleeve member 9 is in tight contact with the surface of the spherical construction member 1. The connecting rod member 5 can be connected to another spherical construction member 1 by means of the extensible and contractible connecting screw member. Various patterns, models, and objects can be constructed by connecting the spherical construction members 1 and construction rod members 5 of the present invention.

Figure 5:
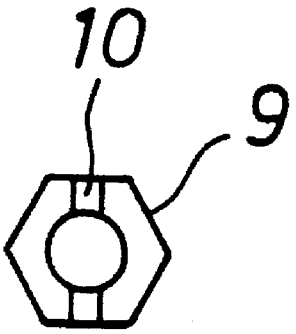
FIG. 5 is a cross section view of a hexagonal screw fastening sleeve member.
Figure 6:
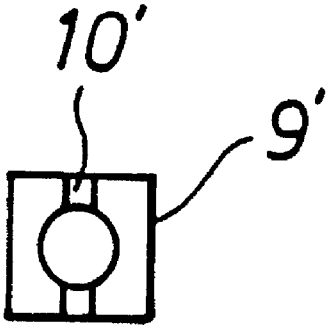
FIG. 6 is a cross section view of a square screw fastening sleeve member.

FIGS. 5 and 6 show cross section views of two embodiments of screw fastening sleeve members 9 and 9' having longitudinally extending orientation slots 10 and 10' respectively. The slots 10, 10' are adapted to receive therein the ends of the orientation pin 12 being secured to the screw 7, whereby screw 7 can be screwed and tightened into a selected threaded opening on the spherical construction member 1 by wrenching the screw fastening sleeve member 9, 9' by means of a wrench.

While the present invention has been shown with particular reference to a preferred embodiment thereof, it is appreciated that various other changes or modifications may be made without departing from the scope of the present invention.

What is claimed is:

1. A sphere and rod construction toy comprising generally spherical construction members and rod members for connecting said spherical construction members whereby:

said generally spherical construction members are hollow having five threaded openings provided at both the upper and lower hemispheres thereof and having four to eight threaded openings provided along the equator thereof; the axis of each threaded opening passes through the center of the spherical member; and said rod members are extensible and contractible;

and wherein said extensible and contractible rod members comprise a hollow rod member, each end of which having a ring member being secured within an inner wall thereof, a screw slidably received in said ring member with its threaded portion extending out the end of said hollow rod member, an orientation pin being fixedly received in a transverse opening on said screw, and a screw fastening sleeve member slidably connected along said screw between said ring member and said orientation pin, said screw fastening sleeve member having orientation slots for receiving therein the ends of said orientation pin, whereby said rod members can be connected to said generally spherical construction members by wrenching said screw fastening sleeve member with a wrench thereby screwing said screw into a said threaded opening.

2. A sphere and rod construction toy as claimed in claim 1 wherein one of the five threaded openings is disposed on the surface of said generally spherical construction member along a central vertical axis thereof and the other four threaded openings are disposed on the surface of said generally spherical construction member at 45° from said central vertical axis.

3. A sphere and rod construction toy as claimed in claim 1 wherein the surfaces on said generally spherical construction member at each threaded opening is flat forming a construction member having 14–18 surfaces.

4. A sphere and rod construction toy as claimed in claim 1 wherein said screw fastening sleeve member is hexagonal in section.

5. A sphere and rod construction toy as claimed in claim 1 wherein said screw fastening sleeve member is square in section.

* * * * *